United States Patent [19]

Jokel

[11] Patent Number: 4,899,490

[45] Date of Patent: Feb. 13, 1990

[54] WINDOW INTRUSION BARRIER "B"

[76] Inventor: Isidore Jokel, 420 Newport "H", Deerfield Beach, Fla. 33441

[21] Appl. No.: 313,772

[22] Filed: Feb. 21, 1989

Related U.S. Application Data

[63] Continuation-in-part of Ser. No. 224,673, Jul. 27, 1988, Pat. No. 4,837,974, which is a continuation-in-part of Ser. No. 948,204, Dec. 31, 1986, abandoned, which is a continuation-in-part of Ser. No. 854,428, Apr. 21, 1986, Pat. No. 4,680,890.

[51] Int. Cl.[4] ..... E06B 3/68

[52] U.S. Cl. ..... 49/55; 49/57; 70/461

[58] Field of Search ..... 49/55, 57, 449, 450; 70/238, 461 X

[56] References Cited

U.S. PATENT DOCUMENTS

| | | | |
|---|---|---|---|
| 1,451,172 | 4/1923 | Mayer | 49/55 |
| 2,508,302 | 5/1950 | Stue | 70/238 X |
| 2,775,001 | 12/1956 | Baker | 49/449 X |
| 2,819,500 | 1/1958 | Saber | 49/55 X |
| 4,170,885 | 10/1979 | Lundgren | 49/449 X |
| 4,394,805 | 7/1983 | Napper | 49/55 |
| 4,437,265 | 3/1984 | Turro et al. | 49/57 |
| 4,680,890 | 7/1987 | Jokel | 49/55 |

*Primary Examiner*—Philip C. Kannan
*Attorney, Agent, or Firm*—M. K. Silverman

[57] ABSTRACT

The invention relates to a barrier apparatus for a framed vertically adjustable rectangular window, the apparatus having an adjustable length for insertion into a window casement of the window. It is slidably positionable within the casement. The barrier apparatus includes a first and a second gridwork panel horizontally spaced on co plan juxtaposition; the panels are rigid rectangular frames adapted to border and support the panels, each frame having horizontally disposed upper and lower borders, and inner and outer vertically oriented side borders, the inner side borders facing each other, the facing side borders having vertically spaced guide holes. Also provided are first and second horizontally directed posts affixed between the upper and lower horizontal borders of each panel, such posts affixed to the facing inner side borders and adapted to slidably penetrate the guide holes, the horizontally directed posts having uniformly spaced pairs of notches.

5 Claims, 3 Drawing Sheets

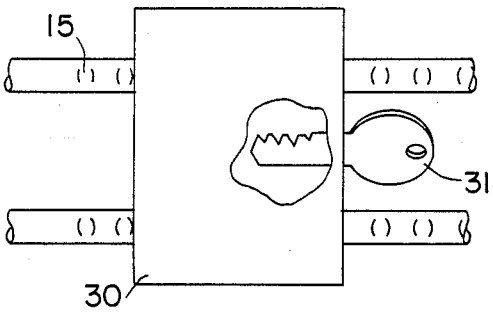
FIG. 3
FIG. 4
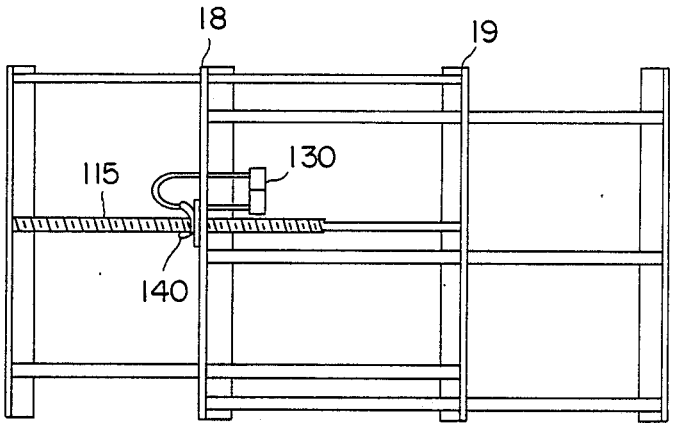
FIG. 6
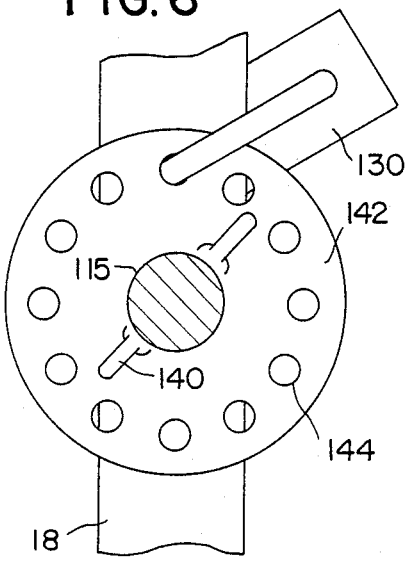
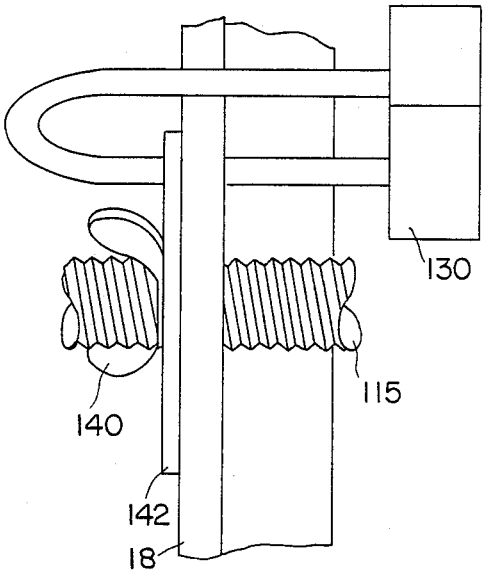
FIG. 5

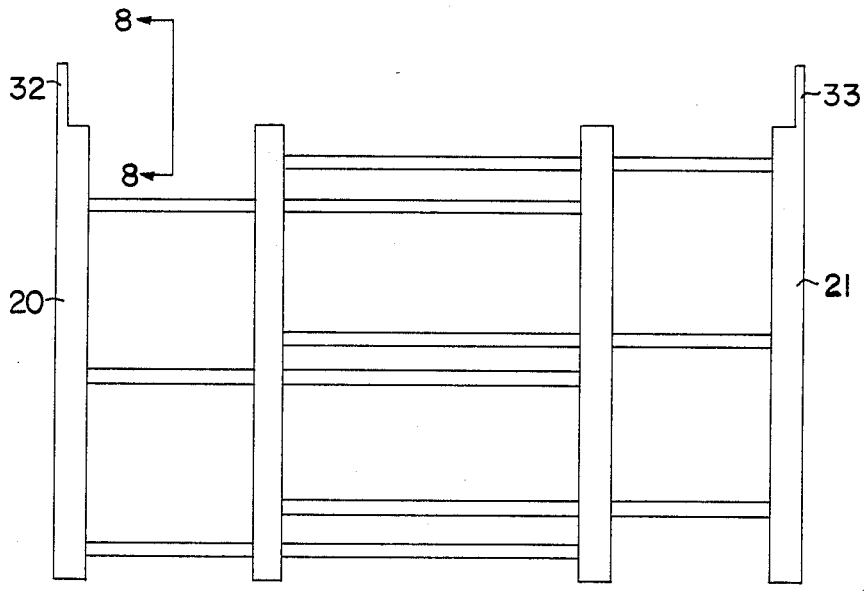
FIG.7
FIG.8
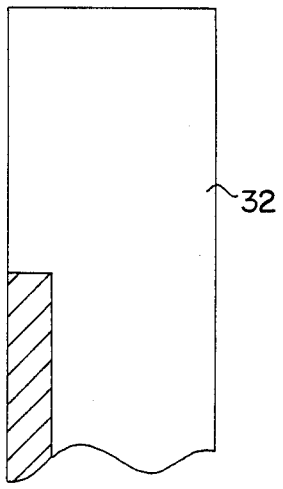

WINDOW INTRUSION BARRIER "B"

REFERENCE TO THE INVENTION

This application is a continuation-in-part of application Ser. No. 224,673, filed July 27, 1988, now U.S. Pat. No. 4,837,974, which is a continuation-in-part of application Ser. No. 948,204, filed Dec. 31, 1986, abandoned, which is a continuation-in-part of application Ser. No. 854,428, filed Apr. 21, 1986, now U.S. Pat. No. 4,680,890.

BACKGROUND OF THE INVENTION

This invention concerns an apparatus for the prevention of unauthorized entry by a person into a building and, more particularly, concerns a barrier apparatus of adjustable dimensions which may be removably inserted into the framework of an open window of a building to prevent passage therethrough.

In residential and industrial buildings, windows capable of opening and closing, and having transparent panels, serve to permit entrance of sunlight and passage of air, and function and emergency exits in case of fire. However, when such windows are open, the security of the building is threatened because of the relative ease with which an intruder may enter through the open window.

Various devices have been disclosed for thwarting unauthorized entrance through an open window while still retaining most of the functionality of the window. Such devices, however, have not heretofore been entirely successful. For complete effectiveness, the barrier device should be capable of easy installation into, and rapid removal from, variously sized window casements while being non-removable by a would-be intruder. The barrier should furthermore provide minimal occlusion of the area it occupies while having sufficient strength to resist forceful breakage.

The pertinent prior art, as best known to the inventor, is reflected in unpatented products knows as (1) WIND-O-GUARD, produced by The Leslie Lock Company of Atlanta, Ga. 30339 and (2) BURGLAR BARS, produced by Sterling Hardware Corp. of Richmond, Ill. 60071. The instant invention also represents an improvement over may U.S. Pat. Nos. 4,532,734 and 4,573,285, and over U.S. Pat. Nos. 2.508,302 and 4,437,265.

SUMMARY OF THE INVENTION

The invention relates to a barrier apparatus for a framed vertically adjustable rectangular window, the apparatus having an adjustable length for insertion into a window casement of such window. The apparatus is slideably positionable within such casement. Said barrier apparatus, comprises a first and a second gridwork panel horizontally spaced in substantially co-planar juxtaposition, said panels comprising rigid rectangular frames adapted to border and support said panels, each frame comprising horizontally disposed upper and lower borders, and inner and outer vertically oriented side borders, said inner side borders facing each other, said facing side borders having vertically spaced guide holes.

Further provided are first and second horizontally directed posts affixed medially between said upper and lower horizontal borders of each panel, said posts affixed to said facing inner sideborders and adapted to slidably penetrate said guide holes, said horizontally directed posts having a plurality of uniformly spaced pairs of notches thereon.

Yet further provided are locking means for mutually securing said first and second horizontal posts relative to each other, said locking means having a pair of parallel cylindrical apertures having internal surfaces for complemental slideably contact with said notched pairs of said horizontal posts, thereby defining the vertical extent of slidable horizontal length of said barrier apparatus.

It is an object to provide a modified slideably positionable window guard such that the window may be opened to permit passage of air therethrough while preventing the entry of an intruder.

It is another object to provide a barrier apparatus of an adjustable horizontal size capable of facile insertion into the rectangular space of the window casement of an open vertically slidable window.

It is a further object to provide a barrier apparatus having the above advantages, that can be readily removed by a user but not readily removed by a would-be intruder.

It is a yet further object to provide a barrier apparatus of the above nature having durable construction which, nonetheless, may be economically manufactured.

The above and yet other advantages of the present invention will become apparent from the hereinafter set forth Detailed Description of the Invention, the Drawings, and Claims appended herewith.

BRIEF DESCRIPTION OF THE DRAWINGS

With regard to

FIG. 3 is an enlarged view of the locking apparatus of FIGS. 1 and 2.

FIG. 4 is a view of a second embodiment of a locking means for the barrier apparatus.

FIG. 5 is an enlarged view of the locking means of FIG. 4.

FIG. 6 is an axial plane view of the locking means of FIG. 4.

FIG. 7 is a front elevational view showing the extension elements of the barrier apparatus.

FIG. 8 is a side planned view taken along line 8—8 of FIG. 7.

DETAILED DESCRIPTION OF THE INVENTION

Figure 1:
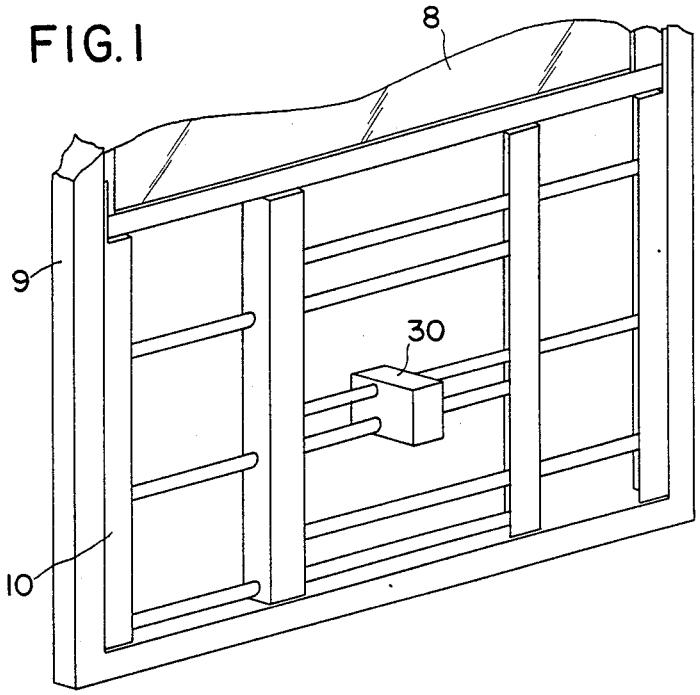
FIG. 1 there is shown, in perspective means, the inventive barrier apparatus with the locking means secured thereto.
Figure 2:
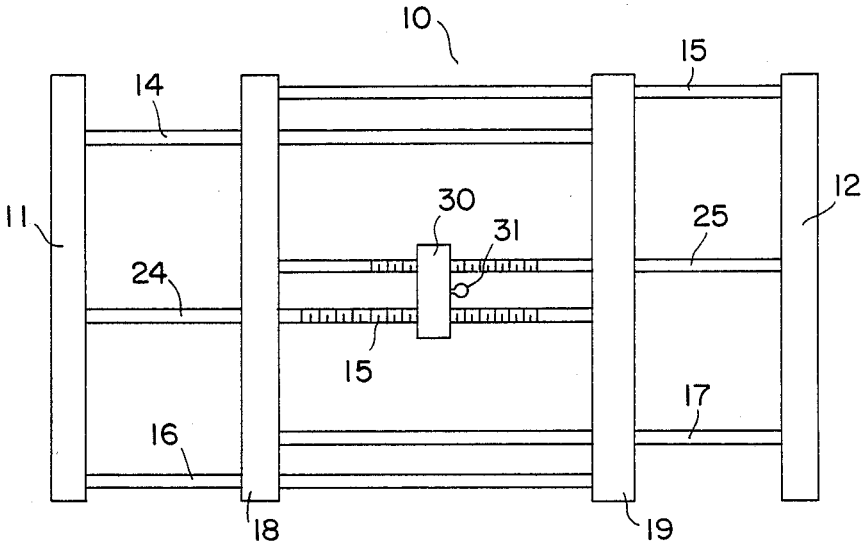
FIG. 2 is a front elevational view of the gridwork panels of the barrier apparatus and locking means.

With reference to FIGS. 1 and 2, there is shown a barrier apparatus 10 disposed within a framed vertically adjustable rectangular window 8. The barrier apparatus exhibits and adjustable horizontal length for insertion into a window casement 9 of said rectangular window 8, within which said barrier apparatus is slideably positionable.

The barrier apparatus 10 comprises a first and second gridwork panels (see FIG. 2) horizontally spaced and in substantially co-planar juxtaposition. Said panels comprise rigid rectangular frames adapted to border and support said first and second panels. The first gridwork panel comprises a horizontally disposed upper border 14 and a lower border 16, as well as an outer vertically oriented side border 11 and inner vertically oriented side border 19.

The second gridwork panel comprises horizontally disposed upper border 15 and horizontally disposed lower border 17 and, as well, comprises inner vertically oriented side border 18 and outer vertically oriented side border 12. Said inner side borders 18 and 19 are parallel and face each other. Further, said facing said borders 18 and 19 are provided with vertically spaced guide holes (see FIG. 1).

Between upper and lower horizontal borders are disposed first horizontally directed posts 24 and second horizontally directed post 25. These are medially disposed between the respective lower and upper borders of the respective gridwork panels.

Said posts 24 and 25 are affixed to facing inner side borders 18 and 19 respectively and are adapted to slideably penetrate through said side holes in order to thereby permit the slidably positionability of said first gridwork panel relative to said second gridwork panel Said horizontally directed posts 24 and 25 are uniformly spaced and are provided with pairs of notches 45 thereupon.

There is further provided locking means 30 which serve to mutually secure said first and second horizontal posts 24 and 25. Said locking means are provided with a pair of parallel cylindrical apertures having internal tumbler structure which are complemental to said notches 45. Thereby, the locking means 30 may be selectively advanced relative to posts 24 and 25 to a position suitable for locking after first and second gridwork panels have been horizontally extended to the desired position relative to casement 9. Key 31 is employed to lock locking means 31 at such desired position. This is particularly shown in FIG. 3.

With reference to FIGS. 4 to 6, there is shown a second embodiment of the locking means. In this embodiment, the locking means comprises a wing nut 140 and washer 142 wherein said washer threadably encircles a threaded post 115. Through this mechanism, the extend of horizontal extension of first gridwork panel relative to second gridwork panel is delimited by the position which wing nut 140 is locked.

In addition, post 18 is provided with at least one aperture which is suitable for co-alignment with radial apertures 144 of said washer 142. Once such co-alignment is achieved, the shank of padlock 130 may be placed between said radial aperture 144 and said aperture placed within said vertical side border 18. This may be more clearly seen in the enlarged view of FIGS. 5 and 6.

With reference to FIG. 7, there is shown element 32 which integrally extends upward from the left-hand border 20 of first gridwork panel. A similar extension element 33 extends from right-hand border 21 of second gridwork panel. Such extension elements are adapted to wedge between said window casement 9 and the framed horizontal window 8 such that extension elements 32 and 33 will secure the inventive barrier apparatus in position within the window casing relative to the window when the same is closed vertically downward on the top border 15 of said barrier apparatus.

While there has been herein shown and described the preferred embodiments of the present invention, it is to be understood the invention may be embodied otherwise than is herein illustrated and described and that in said embodiments, certain changes in the detailed construction, and in the form and arrangement of parts may be made without departing from the underlying idea or principles of this invention within the scope of the appended claims.

Having thus described my invention, what I claim as new, useful, and non-obvious and, accordingly secured by Letters Patent of the United States is:

1. A barrier apparatus for a framed vertically adjustable rectangular window, the apparatus having an adjustable length for insertion into a window casement of said window, said apparatus slidably positionable within said casement, said barrier apparatus, comprising:

(a) a first and a second gridwork panel in horizontally spaced co-planar juxtaposition, said panels comprising rigid rectangular frames adapted to border and support said panels, each frame comprising horizontally disposed upper and lower borders, and inner and outer vertically oriented side borders said inner side borders facing each other, said facing side borders having vertically spaced guide holes;

(b) first and second horizontally directed posts affixed medially between said upper and lower horizontal borders of each panel, said posts affixed to said facing inner sideborders and adapted to post through said guide hole, said horizontally directed posts having a plurality of co-vertically spaced pairs of notches thereon;

(c) locking means for mutually securing said first and second horizontal posts relative to each other, said locking means having a pair of parallel cylindrical apertures having internal surfaces for complemental contact with said notched pairs of said horizontal post, thereby defining the horizontal extend of slidable horizontal length of said barrier apparatus.

2. The barrier apparatus recited in claim 1, further comprising extension element integrally extending upward from the left hand border of said first gridwork panel and from the right hand side panel said second gridwork panel, said extension element adapted to wedge between said window casement and in the framed horizontal window therein, such that said extension element will secure the barrier apparatus in position within the window casement and relative to the frame rectangular window when closed vertically downward on the top border of said barrier apparatus.

3. The barrier apparatus for a vertically adjustable window, the apparatus having an adjustable length adapted for insertion into a window casement below a framed rectangular window slidably positionable within said casement, the barrier apparatus comprising;

(a) a first and second gridwork panel horizontally spaced in substantially co-planar juxtaposition, said panels comprising rigid rectangular frames adapted to border and support said panels, each frame comprising horizontally disposed upper and lower borders, and inner and outer vertically oriented side borders, said inner side borders facing each other, said facing side borders having vertically spaced side holes.

(b) first and second horizontally directed posts affixed medially between upper and lower borders of each panels, said posts affixed to said facing inner side borders adapted to post through guide holes, one of said horizontally directed posts having a threaded exterior surface; and (c) locking means comprising a wing nut and a washer, said washer threadably encircling said threaded post, said washer having a plurality of radially disposed apertures, said washer located between said wing nut and one of said vertically inner side border whereby said threaded posts may be secured to said vertical inner side borders through a rotational advancement of said wing nut upon said one of said horizontal post having threaded extension surface.

4. The barrier apparatus as recited in claim 3 further comprising further locking means comprising a padlock, the shank of which is placed through a horizontal aperture of one of said vertical side borders, thereby providing a redundant locking capability for the barrier apparatus.

5. The barrier apparatus as recited in claim 4 further comprising extension element integrally extending upward from the lefthand border of said first gridwork panel and from the righthand side panel said second gridwork panel, said extension element adapted to wedge between said window casement and the framed horizontal window therein, such that said extension element will secure the barrier apparatus in position within the window casement and relative to the frame rectangular window when closed vertically downward on the top border of said barrier apparatus.

* * * * *